US009052641B2

(12) United States Patent
Itabashi

(10) Patent No.: US 9,052,641 B2
(45) Date of Patent: Jun. 9, 2015

(54) DEVELOPING CARTRIDGE HAVING FRAME TO WHICH SEAL IS ASSEMBLED WITHOUT ADHESION

(71) Applicant: Nao Itabashi, Nagoya (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/032,274

(22) Filed: Sep. 20, 2013

(65) Prior Publication Data

US 2014/0086619 A1 Mar. 27, 2014

(30) Foreign Application Priority Data

Sep. 21, 2012 (JP) ..... 2012-208911

(51) Int. Cl.
*G03G 15/08* (2006.01)

(52) U.S. Cl.
CPC ..... *G03G 15/0898* (2013.01); *G03G 15/0817* (2013.01)

(58) Field of Classification Search
CPC ..... G03G 15/0817
USPC ..... 399/102, 103, 105
See application file for complete search history.

(56) References Cited

U.S. PATENT DOCUMENTS

| | | | | |
|---|---|---|---|---|
| 5,697,021 | A * | 12/1997 | Watanabe et al. | 399/102 |
| 2001/0009618 | A1* | 7/2001 | Ohgoshi et al. | 399/103 |
| 2003/0002883 | A1* | 1/2003 | Sato et al. | 399/102 |
| 2006/0245783 | A1* | 11/2006 | Kamimura et al. | 399/103 |
| 2011/0064453 | A1* | 3/2011 | Xu et al. | 399/103 |

FOREIGN PATENT DOCUMENTS

JP 2007-188109 A 7/2007

* cited by examiner

*Primary Examiner* — Benjamin Schmitt
(74) *Attorney, Agent, or Firm* — Banner & Witcoff, Ltd.

(57) ABSTRACT

A developing cartridge includes: a frame defining a developer chamber for accommodating developer and being formed with an opening elongated in a longitudinal direction for allowing the developer to flow out of the developer chamber; a member assembled to the frame at a position opposite to the developer chamber with respect to the opening; a seal extending in the longitudinal direction and interposed between the member and the frame; and a protrusion protruding into the seal from at least one of the frame and the member in a protruding direction crossing the longitudinal direction, the protrusion being configured to restrict the seal from moving in the longitudinal direction.

12 Claims, 10 Drawing Sheets

DEVELOPING CARTRIDGE HAVING FRAME TO WHICH SEAL IS ASSEMBLED WITHOUT ADHESION

CROSS REFERENCE TO RELATED APPLICATION

This application claims priority from Japanese Patent Application No. 2012-208911 filed Sep. 21, 2012. The entire content of the priority application is incorporated herein by reference.

TECHNICAL FIELD

The present invention relates to a developing cartridge mountable in an electrophotographic image forming apparatus.

BACKGROUND

A conventional electrophotographic image forming apparatus detachably accommodates developing devices therein. Developing devices that are detachably mounted in this type of printer include a case for accommodating toner, a developing roller supported in this case for carrying toner on its peripheral surface, and a thickness-regulating blade that regulates a thickness of toner carried on the peripheral surface of the developing roller. The developing roller and thickness-regulating blade are arranged in this developing device at positions near an opening formed in the case. Consequently, it is necessary to prevent toner from leaking out of the case through gaps between the case and developing roller and between the case and thickness-regulating blade.

To prevent such toner leakage, there was proposed a developing device provided with a lower film, and an upper seal for preventing toner from leaking out through gaps between the case and other components of the developing device (for example, see Japanese patent application publication no. 2007-188109). This developing device is configured such that the lower film presses against the developing roller to suppress toner leakage between the developing roller and the case, while the upper seal presses against the thickness-regulating blade to suppress toner leakage between the thickness-regulating blade and the case.

SUMMARY

However, the lower film and the upper seal in the developing device described above are affixed to the case with double-sided tapes. Consequently, if wrinkles are formed in the double-sided tapes when affixing the lower film and upper seal to the case, toner can leak out through gaps formed between the case and the wrinkles in the tapes. Therefore, great care must be used when affixing the lower film and upper seal so that wrinkles are not formed in the double-sided tapes.

In view of the foregoing, it is an object of the present invention to provide a developer cartridge having seals that are easily mounted in the developer cartridge and that reliably suppress the leakage of developer.

In order to attain the above and other objects, there is provided a developing cartridge including: a frame, a member, a seal and a protrusion. The frame defines a developer chamber therein for accommodating developer, the frame having an opening elongated in a longitudinal direction for allowing the developer to flow out of the developer chamber. The member is assembled to the frame at a position opposite to the developer chamber with respect to the opening. The seal extends in the longitudinal direction and is interposed between the member and the frame. The protrusion protrudes into the seal from at least one of the frame and the member in a protruding direction crossing the longitudinal direction, the protrusion being configured to restrict the seal from moving in the longitudinal direction.

DETAILED DESCRIPTION

1. Overall Structure of Printer

Figure 1:
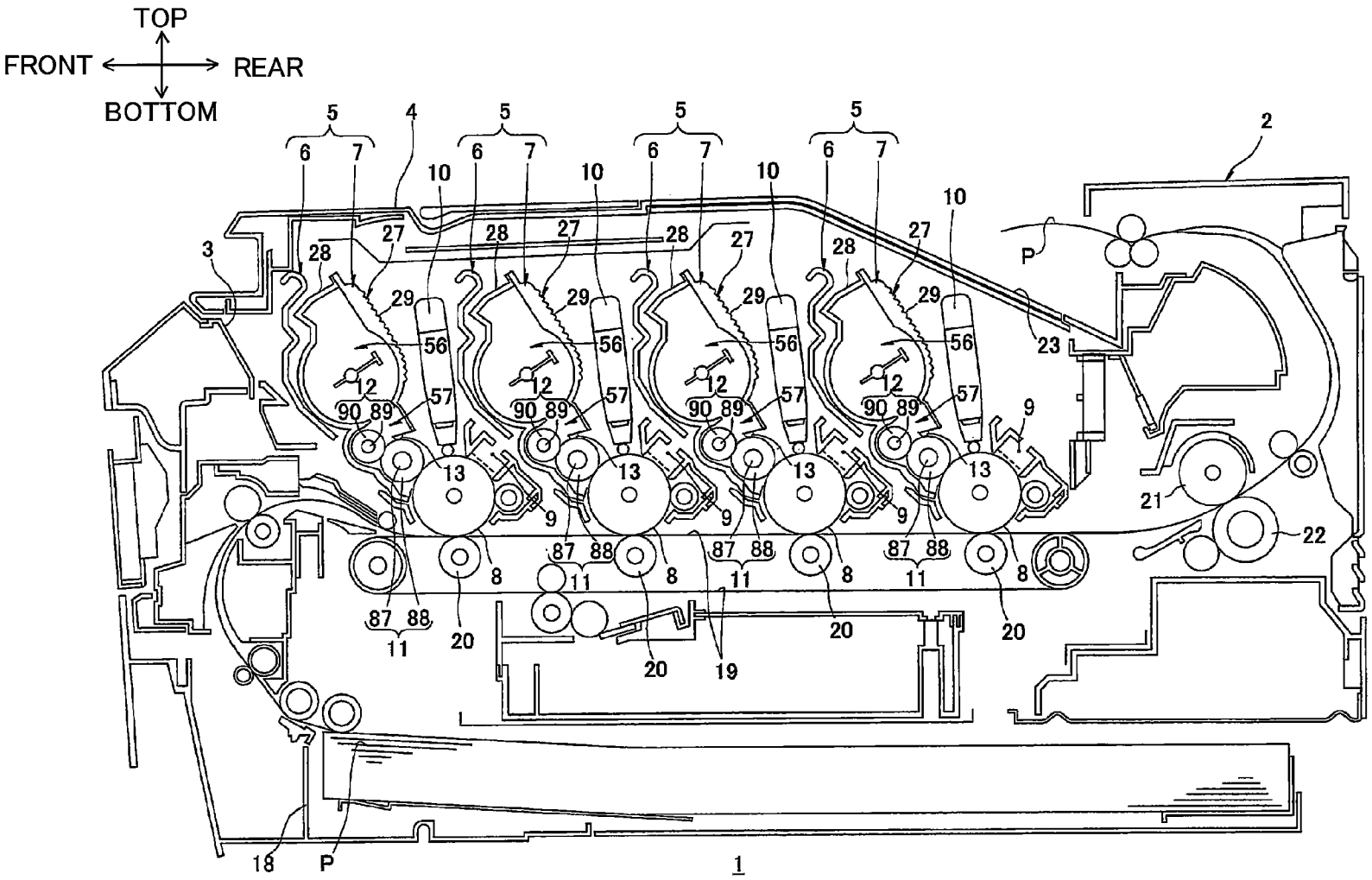
FIG. 1 is a cross-sectional side view showing a general configuration of a printer that accommodates a developing cartridge according to a first embodiment of the present invention.

A printer 1 is a direct horizontal tandem-type color printer, as shown in FIG. 1. The printer 1 is an example of an image-forming apparatus in which developing devices according to a first embodiment of the present invention are detachably accommodated.

In the following description, directions related to the printer 1 will be given under an assumption that the printer 1 is resting on a level surface, and particularly will correspond to the directions of arrows indicated in accompanying drawings.

The printer 1 includes a main casing 2 that has a box-like shape. An access opening 3 is formed in a top portion of the main casing 2. A top cover 4 is pivotably disposed on the top portion of the main casing 2 over the access opening 3 and is capable of pivoting about its rear edge to expose or cover the access opening 3. The printer 1 also includes four process cartridges 5. The process cartridges 5 are all detachably mountable in the main casing 2 through the access opening 3. The process cartridges 5 are disposed in parallel and spaced at intervals in a front-rear direction. The process cartridges 5 are provided for each of four colors (black, yellow, magenta, and cyan).

Each of the process cartridges 5 includes a drum cartridge 6, and a developing cartridge 7 detachably mountable in the drum cartridge 6.

The drum cartridge 6 is provided with a photosensitive drum 8, and a Scorotron charger 9.

The photosensitive drum 8 has a general cylindrical shape, with its axis aligned in a left-right direction. The photosensitive drum 8 is rotatably disposed in the drum cartridge 6.

The Scorotron charger 9 is disposed so as to confront the photosensitive drum 8 from an upper-rear side thereof.

The developing cartridge 7 is provided with a developing roller 11, and a supply roller 12 for supplying toner to the developing roller 11.

The developing roller 11 includes a developing-roller shaft 87 aligned in the left-right direction, and a rubber roller 88 that covers the developing-roller shaft 87.

The developing-roller shaft 87 has a general columnar shape that is elongated in the left-right direction.

The rubber roller 88 covers the developing-roller shaft 87 while leaving left and right end portions of the developing-roller shaft 87 exposed.

The developing roller 11 is provided in the developing cartridge 7, with left and right end portions of the developing-roller shaft 87 rotatably supported to side walls 35 of a cartridge frame 27 (described later). The developing roller 11 contacts the photosensitive drum 8 from an upper-front surface thereof.

The supply roller 12 includes a supply-roller shaft 89 aligned in the left-right direction, and a sponge roller 90 that covers the supply-roller shaft 89.

The supply-roller shaft 89 has a general columnar shape and is elongated in the left-right direction.

The sponge roller 90 covers the supply-roller shaft 89 while exposing the left and right ends of the same.

The supply roller 12 is provided in the developing cartridge 7 with both ends of the supply-roller shaft 89 rotatably supported to the side walls 35 of the cartridge frame 27 (described later). The supply roller 12 contacts the developing roller 11 from an upper-front side thereof.

The developing cartridge 7 also includes a thickness-regulating blade 13 for regulating a thickness of toner carried on a peripheral surface of the developing roller 11.

The developing cartridge 7 also functions to accommodate toner. Toner accommodated in the developing cartridge 7 is tribocharged with a positive polarity between the supply roller 12 and developing roller 11 when supplied onto the surface of the developing roller 11, while the thickness-regulating blade 13 maintains the toner carried on the surface of the developing roller 11 at a thin layer of uniform thickness.

In the meantime, the Scorotron charger 9 applies a uniform charge to a peripheral surface of the photosensitive drum 8. Subsequently, an LED unit 10 disposed above and in confrontation with the photosensitive drum 8 irradiates light onto the surface of the photosensitive drum 8 based on prescribed image data, forming an electrostatic latent image on the surface. Next, the toner carried on the surface of the developing roller 11 is supplied to the latent image formed on the surface of the photosensitive drum 8, developing the latent image into a toner image.

Sheets P of paper are accommodated in a paper tray 18 provided in a bottom section of the main casing 2. Various rollers convey the sheets P along a U-shaped path for redirecting the sheets P upward and rearward, and supply the sheets P one at a time between the photosensitive drums 8 and a conveying belt 19 at a prescribed timing. The conveying belt 19 continues to convey each sheet P rearward between each of the photosensitive drums 8 and a corresponding transfer roller 20. At this time, toner images of all four colors formed on the photosensitive drums 8 are sequentially transferred onto the sheet P.

The sheet P subsequently passes between a heating roller 21 and a pressure roller 22. The heating roller 21 and pressure roller 22 apply heat and pressure, respectively, to the sheet P for fixing the toner image. Next, the sheet P is conveyed along a U-shaped path that redirects the sheet P upward and forward, and the sheet P is discharged onto a discharge tray 23 provided on the top cover 4.

2. Developer Cartridges

Figure 2:
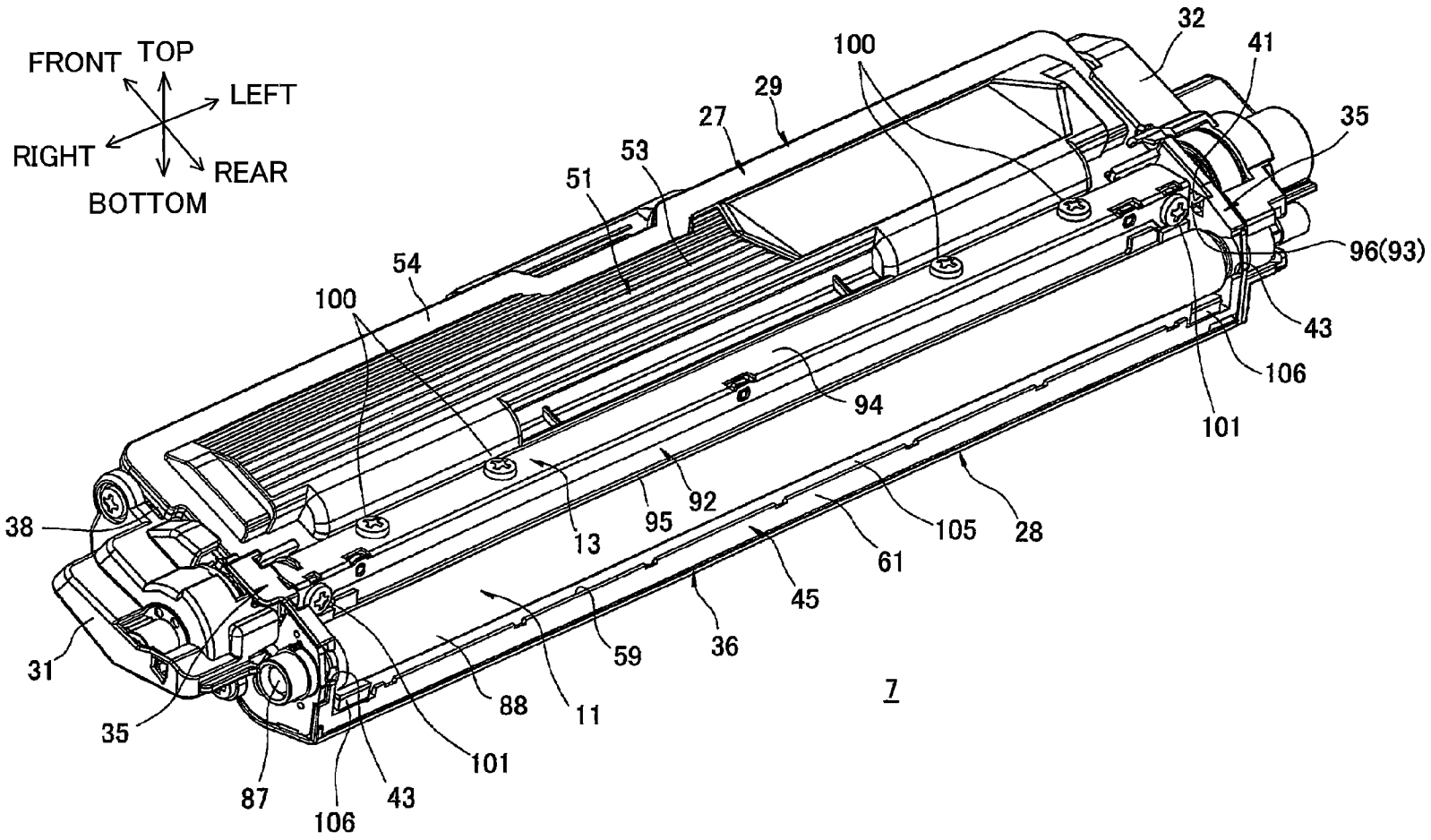
FIG. 2 is a perspective view of the developing cartridge shown in FIG. 1 as viewed from its upper-right side.

As shown in FIGS. 2 and 6, the developing cartridge 7 includes the cartridge frame 27.

A power unit 31 is provided on a right end of the cartridge frame 27 for inputting power from an external source. Further, a drive unit 32 is provided on a left end of the cartridge frame 27. The drive unit 32 has a gear train (not shown) for inputting a drive force from the printer 1.

When giving directions in the following description of the developing cartridge 7, the side of the developing cartridge 7 on which the developing roller 11 is disposed (right side in FIG. 6) will be considered as the rear side, while the opposite side (left side in FIG. 6) will be considered as the front side. Further, the side of the developing cartridge 7 on which the thickness-regulating blade 13 is disposed (upper side in FIG. 6) will be considered as the upper side, while the opposite side (lower side in FIG. 6) will be considered as the lower side. Left and right sides of the developing cartridge 7 will be based on the perspective of a user facing the developing cartridge 7 from the front. Thus, the near side of the developing cartridge 7 in FIG. 6 will be considered as the right side, while the far side of the developing cartridge 7 in FIG. 6 will be considered as the left side. Hence, upward, downward, forward, and rearward directions relative to the developing cartridge 7 differ slightly from those related to the printer 1. That is, the developing cartridge 7 is mounted in the printer 1 and drum cartridge 6 such that the rear side of the developing cartridge 7 is coincident with the lower rear side of the printer 1 and the front side of the developing cartridge 7 is coincident with the upper front side of the printer 1.

Figure 3:
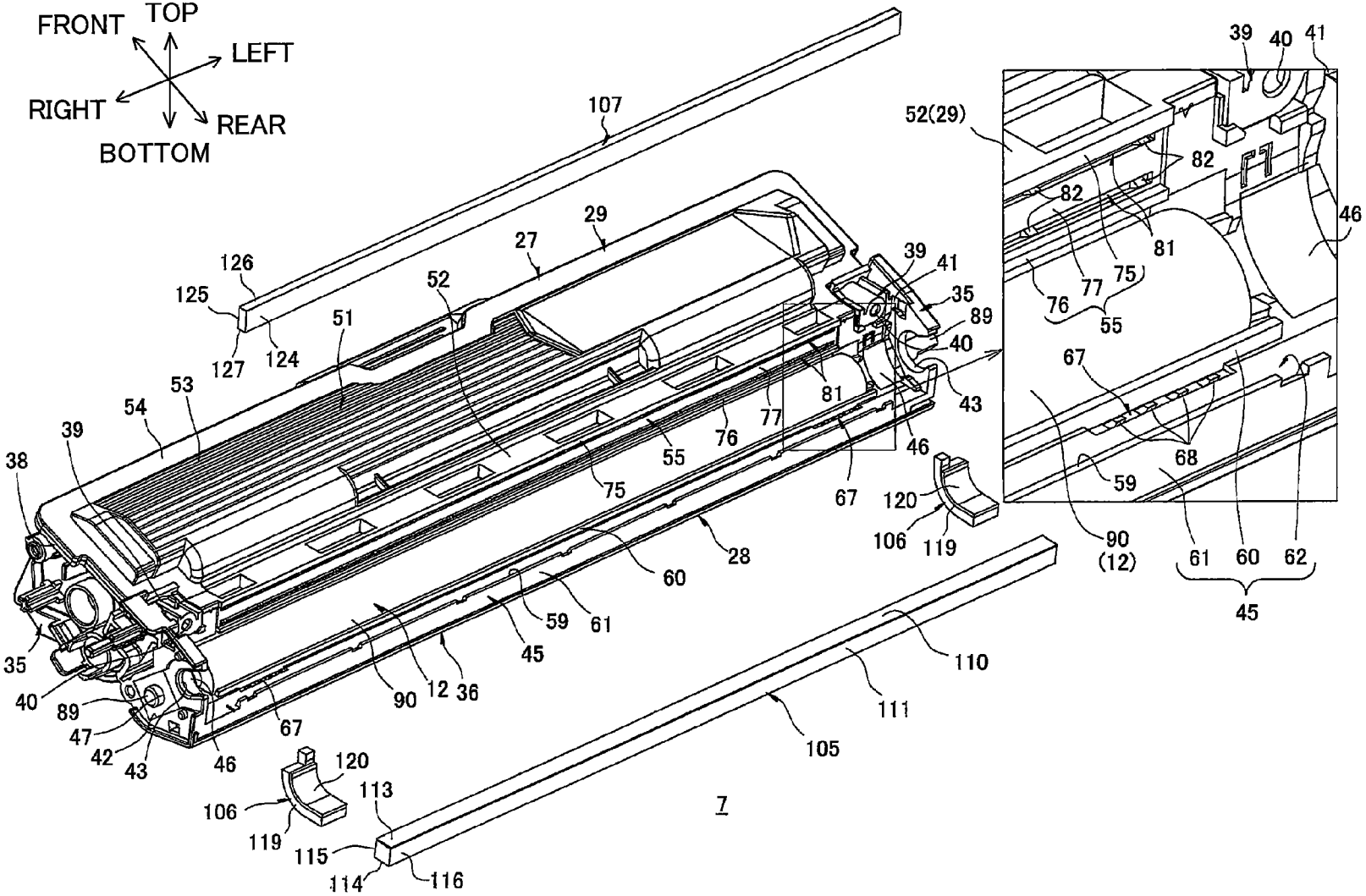
FIG. 3 is an exploded perspective view of the developing cartridge of FIG. 2, illustrating how a lower seal and an upper seal are assembled to the developing cartridge.
Figure 6B:
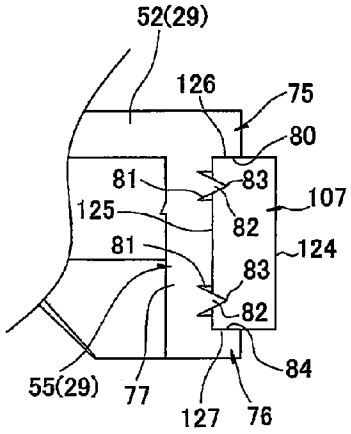
FIG. 6B is an enlarged cross-sectional view showing an essential portion of an upper-seal retaining unit, wherein the upper seal is retained in the upper-seal retaining unit.
Figure 6C:
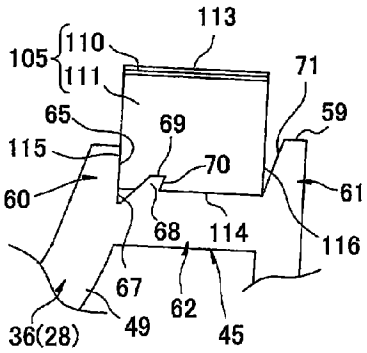
FIG. 6C is an enlarged cross-sectional view showing an essential portion of a lower-seal retaining unit, wherein the lower seal is retained in the lower-seal retaining unit.
Figure 6A:
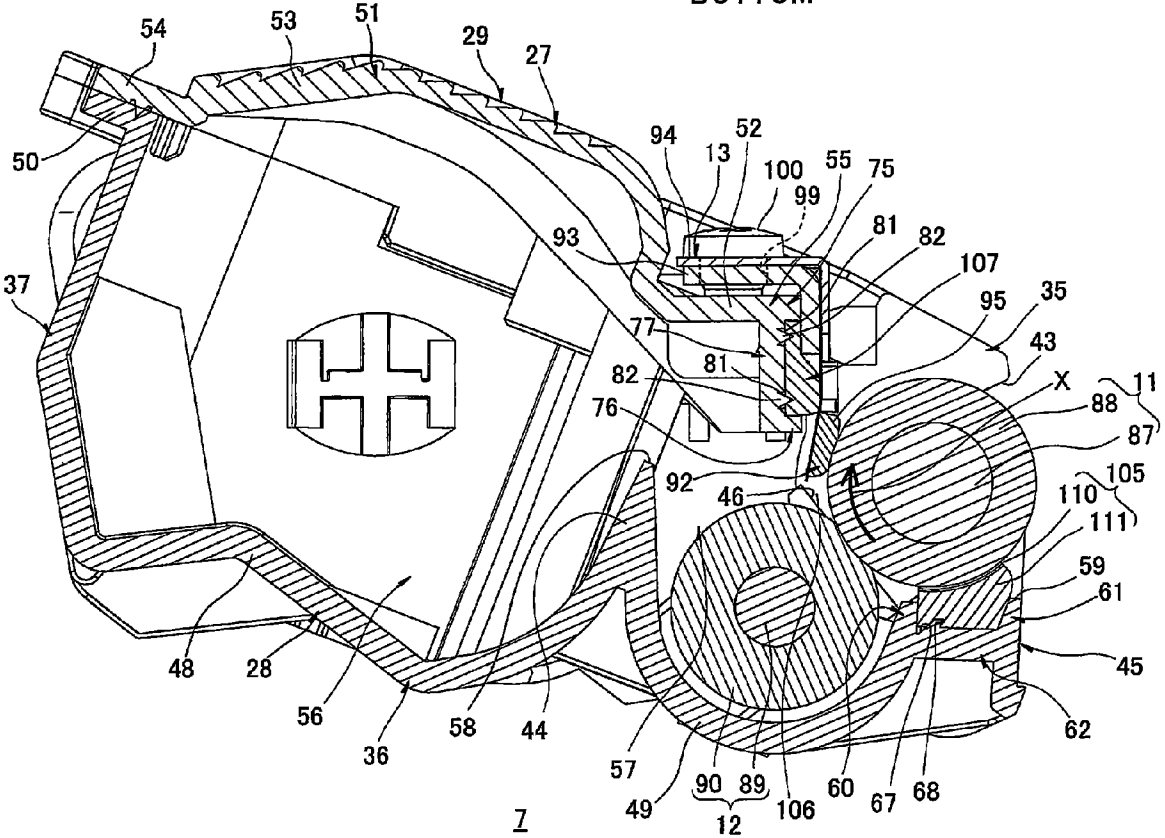
FIG. 6A is a side cross-sectional view of the developing cartridge of FIG. 2.

As shown in FIGS. 3 and 6A, the cartridge frame 27 has a box-like shape that is open on its top and is elongated in the left-right direction. The cartridge frame 27 includes a lower frame 28, and an upper frame 29 assembled on the lower frame 28.

(1) Lower Frame

The lower frame 28 includes a pair of side walls 35, a bottom wall 36, and a front wall 37.

(1-1) Side Walls

As shown in FIG. 3, the side walls 35 have a generally flat plate shape and are substantially rectangular in a side view and elongated in vertical and front-rear directions. The side walls 35 are arranged parallel to each other and spaced apart in the left-right direction. Each of the side walls 35 is provided with a first contact-receiving part 38, a blade-fixing part 39, an engaging groove 41, a supply-roller-exposing hole 42, and a developing-roller-exposing groove 43.

The first contact-receiving part 38 is formed on a front end portion of each side wall 35. Each first contact-receiving part 38 has a generally flat plate shape that extends outward in the respective left or right direction from a top edge of the corresponding side wall 35.

The blade-fixing part 39 is provided on a rear portion of each side wall 35. The blade-fixing part 39 has a generally square columnar shape and protrudes inward in the respective left or right direction from a top edge of the rear portion of respective side wall 35. A first threaded hole 40 is formed in a rear surface of the blade-fixing part 39. The first threaded hole 40 is a generally circular hole that is recessed forward into the rear surface of the blade-fixing part 39. A thread is formed on an inner peripheral surface of the first threaded hole 40.

The engaging groove 41 is formed in the upper edge of the rear portion of the corresponding side wall 35 and is a recess formed in an inner left or right surface of the corresponding side wall 35. The engaging groove 41 has a front surface that is formed continuously and is substantially flush with the rear surface of the blade-fixing part 39.

The supply-roller-exposing hole 42 is generally rectangular in a side view and penetrates a lower-rear portion of each side wall 35. The supply-roller-exposing hole 42 has an inner dimension greater than a diameter of the supply-roller shaft 89 at the left and right ends thereof. The left and right ends of the supply-roller shaft 89 are exposed outside the corresponding left and right side walls 35 through the supply-roller-exposing holes 42.

The developing-roller-exposing groove 43 penetrates an upper-rear end portion of the side wall 35, forming a general U-shape in a side view that is open upward and rearward. The developing-roller-exposing groove 43 has a vertical dimension greater than a diameter of the developing-roller shaft 87 at the left and right ends thereof. The left and right ends of the developing-roller shaft 87 are exposed on the outsides of the corresponding left and right side walls 35 through the developing-roller-exposing grooves 43.

(1-2) Bottom Wall

The bottom wall 36 has a generally flat plate shape that extends in the left-right direction and integrally bridges lower edges of the side walls 35. As shown in FIG. 6A, the bottom wall 36 is integrally formed of a bent wall 48, an arc-shaped wall 49, a partitioning wall 44, and a lower-seal-retaining unit 45.

The bent wall 48 constitutes a front portion of the bottom wall 36 and has a side cross section formed in a general W-shape.

The arc-shaped wall 49 is formed continuously from a rear edge of the bent wall 48 and constitutes a rear portion of the bottom wall 36. The arc-shaped wall 49 has a general arc shape that follows the rotational path of the supply roller 12. A pair of supply-roller side seals 46 is provided on the arc-shaped wall 49 (see FIG. 3).

As shown in FIG. 3, the supply-roller side seals 46 are disposed on a top surface of the arc-shaped wall 49, with one at each of the left and right ends. The supply-roller side seals 46 are generally rectangular in a side view. An insertion hole 47 is formed in an approximate center region of each supply-roller side seal 46 in a side view and penetrates the corresponding supply-roller side seal 46 in the left-right direction to allow passage of the supply-roller shaft 89. Each supply-roller side seal 46 has a top surface that is recessed diagonally downward and forward, forming a general arc shape in a side view that conforms to the peripheral surface of the rubber roller 88 constituting the developing roller 11.

As shown in FIG. 6A, the partitioning wall 44 is provided in a connecting area between the front portion and rear portion of the bottom wall 36. The partitioning wall 44 is generally triangular in a side view, with the top of the triangle protruding upward. The partitioning wall 44 is elongated in the left-right direction.

As shown in FIG. 6C, the lower-seal-retaining unit 45 includes a front lower-seal-retaining wall 60, a bottom lower-seal-retaining wall 62, and a rear lower-seal-retaining wall 61.

The front lower-seal-retaining wall 60 is formed continuously with a rear edge of the arc-shaped wall 49, protruding upward therefrom. The front lower-seal-retaining wall 60 has a generally flat plate shape and is substantially rectangular in a side view. The front lower-seal-retaining wall 60 has a rear surface that constitutes an orthogonal surface 65 for retaining a lower seal 105 (described later).

The bottom lower-seal-retaining wall 62 is formed continuously from the rear edge of the arc-shaped wall 49 and a bottom end portion of the front lower-seal-retaining wall 60 and extends rearward. The bottom lower-seal-retaining wall 62 has a generally flat plate shape and is substantially rectangular in a side cross-sectional view. The bottom lower-seal-retaining wall 62 has a top surface that forms an approximate right angle with the orthogonal surface 65 of the front lower-seal-retaining wall 60. Two first accumulating recessed parts 67 are formed in the bottom lower-seal-retaining wall 62.

As shown in FIG. 3, the first accumulating recessed parts 67 are formed in the top surface of the bottom lower-seal-retaining wall 62 along its front edge. The two first accumulating recessed parts 67 are separated in the left-right direction with one formed near the left end of the bottom lower-seal-retaining wall 62 and remaining one near the right end of the bottom lower-seal-retaining wall 62. The first accumulating recessed parts 67 are formed as downward recesses in the top surface of the bottom lower-seal-retaining wall 62 and are generally rectangular in a plan view, extending in the left-right direction. Four first restricting protrusions 68 are provided in each first accumulating recessed part 67.

As shown in FIG. 3 and FIG. 6C, each first restricting protrusion 68 is integrally formed with bottom and rear surfaces of the corresponding first accumulating recessed part 67. Each first restricting protrusion 68 extends upward from the bottom surface of the first accumulating recessed parts 67 and has a protruding end portion (hereinafter called a first distal end portion 69) that protrudes higher than the top surface of the bottom lower-seal-retaining wall 62. The first restricting protrusion 68 is formed to slope rearward from bottom to top, with its rear surface constituting a sloped surface 70 of the first restricting protrusion 68.

The sloped surface 70 forms an angle of approximately 80 degrees (acute angle) with the top surface of the bottom lower-seal-retaining wall 62.

The rear lower-seal-retaining wall 61 is formed continuously from a rear end portion of the bottom lower-seal-retaining wall 62 and extends both upward and downward therefrom. The rear lower-seal-retaining wall 61 has a generally flat plate shape that is substantially rectangular in a side cross-sectional view. The rear lower-seal-retaining wall 61 has an upper portion whose front surface constitutes a sloped surface 71 of the lower-seal-retaining unit 45.

The sloped surface 71 extends upward from a rear edge on the top surface of the bottom lower-seal-retaining wall 62 and slopes rearward from bottom to top.

(1-3) Front Wall

The front wall 37 is formed continuously from a front edge of the bent wall 48 constituting the bottom wall 36 and slopes rearward from bottom to top. The front wall 37 integrally bridges front edges of the side walls 35.

A second contact-receiving part 50 is formed continuously with a top edge of the front wall 37. As shown in FIG. 6A, the second contact-receiving part 50 has a generally flat plate shape and extends diagonally upward and forward from the top edge of the front wall 37.

(2) Upper Frame

The upper frame 29 is integrally provided with a front-side top wall 51, and a rear-side top wall 52.

The front-side top wall 51 includes an expanded part 53, and a contact part 54.

The expanded part 53 constitutes a central portion of the front-side top wall 51 and is formed to expand upward.

The contact part 54 has a generally flat plate shape and is provided along both left and right sides and front side of the expanded part 53 so as to surround the same. When the upper frame 29 is assembled to the lower frame 28, the contact part 54 conforms to the shape of the second contact-receiving part 50 on the front wall 37 and the first contact-receiving part 38 on the side wall 35.

The rear-side top wall 52 has a generally flat plate shape and extends continuously rearward from a rear edge of the front-side top wall 51. The rear-side top wall 52 is provided with an upper-seal-retaining unit 55.

The upper-seal-retaining unit 55 includes a top upper-seal-retaining wall 75, a front upper-seal-retaining wall 77, and a bottom upper-seal-retaining wall 76.

As shown in FIG. 6B, the top upper-seal-retaining wall 75 has a generally flat plate shape that is substantially rectangular in a side cross-sectional view. The top upper-seal-retaining wall 75 is formed continuously from a rear edge of the rear-side top wall 52 and protrudes rearward. The top upper-seal-retaining wall 75 has a bottom surface that constitutes an orthogonal surface 80 of the upper-seal-retaining unit 55.

The front upper-seal-retaining wall 77 has a generally flat plate shape that is substantially rectangular in a side cross-sectional view. The front upper-seal-retaining wall 77 is formed continuously with the rear edge of the rear-side top wall 52 and a front edge of the top upper-seal-retaining wall 75 and extends downward therefrom. The front upper-seal-retaining wall 77 has a rear surface that forms an approximate right angle with the orthogonal surface 80 of the top upper-seal-retaining wall 75. Two second accumulating recessed parts 81 are formed in the front upper-seal-retaining wall 77.

The second accumulating recessed parts 81 are formed in the rear surface of the front upper-seal-retaining wall 77 at positions spaced apart vertically. Hence, one second accumulating recessed part 81 is formed near the top edge of the front upper-seal-retaining wall 77 and the remaining one near the bottom edge of the front upper-seal-retaining wall 77. As shown in FIG. 3, the second accumulating recessed parts 81 are recessed forward into the rear surface of the front upper-seal-retaining wall 77. The second accumulating recessed parts 81 are generally rectangular in a plan view and span across the front upper-seal-retaining wall 77 in the left-right direction. Seventeen second restricting protrusions 82 are provided in each of the second accumulating recessed parts 81.

As shown in FIG. 6B, the second restricting protrusions 82 extend rearward from a front surface of the corresponding second accumulating recessed part 81 so that protruding end portions (hereinafter referred to as second distal end portions 83) protrude farther rearward than the rear surface of the front upper-seal-retaining wall 77. The second restricting protrusions 82 in respective second accumulating recessed parts 81 are positioned so as to overlap each other in a vertical projection.

The bottom upper-seal-retaining wall 76 is a generally flat plate shape and is substantially rectangular in a side cross-sectional view. The bottom upper-seal-retaining wall 76 is formed continuously with the bottom edge of the front upper-seal-retaining wall 77 and extends rearward therefrom. The bottom upper-seal-retaining wall 76 has a top surface that constitutes an orthogonal surface 84 of the upper-seal-retaining unit 55.

The rear surface of the front upper-seal-retaining wall 77 forms an approximate right angle with the orthogonal surface 84.

(3) Cartridge Frame

When the lower frame 28 and upper frame 29 are assembled together as shown in FIG. 6A, the interior of the cartridge frame 27 is divided by the partitioning wall 44 into a toner-accommodating chamber 56 constituting a space forward of the partitioning wall 44, and a developing chamber 57 constituting a space rearward of the partitioning wall 44. A through-hole 58 is formed above the partitioning wall 44 and provides communication between the toner-accommodating chamber 56 and developing chamber 57.

The toner-accommodating chamber 56 accommodates toner in one of the printing colors (black, yellow, magenta, or cyan).

An opening 59 is formed in the cartridge frame 27 on the rear side of the developing chamber 57. Specifically, the opening 59 is defined by the top edge of the rear lower-seal-retaining wall 61 constituting the lower-seal-retaining unit 45 and the rear edge of the orthogonal surface 84 constituting the upper-seal-retaining unit 55. Within the developing chamber 57 are provided the developing roller 11, supply roller 12, and thickness-regulating blade 13, as well as a lower seal 105, two developing-chamber side seals 106, and an upper seal 107.

As will be described later, the developing roller 11 is exposed in the rear end of the developing chamber 57 so that an upper rear portion of the rubber roller 88 is exposed through the opening 59. During a developing operation, a drive force is transmitted to the developing roller 11 from a drive source (not shown), such as a motor, provided in the main casing 2. A power supply (not shown) also applies a developing bias to the developing roller 11 during the developing operation. When the drive force is transmitted from the drive source, the developing roller 11 is driven to rotate, about an axis of the developing-roller shaft 87, in a rotating direction X indicated by an arrow in FIG. 6A (clockwise in a right side view), so that toner supplied from the toner-accommodating chamber 56 is carried on the surface of the rubber roller 88.

As described above, the supply roller 12 is disposed inside the arc-shaped wall 49 by the supply-roller shaft 89 being rotatably supported in the supply-roller-exposing holes 42 formed in the side walls 35. During a developing operation, a drive force is transmitted to the supply roller 12 from a drive source (not shown), such as a motor, provided in the main casing 2. A power supply (not shown) also applies a supply bias to the supply roller 12 during the developing operation. When the drive force is transmitted from the drive source, the supply roller 12 is driven to rotate in a direction opposite to the rotating direction X of the developing roller 11 (i.e., counterclockwise in FIG. 6A).

The thickness-regulating blade 13 is disposed so as to cover a rear end portion of the upper frame 29 across the entire left-right direction. The thickness-regulating blade 13 includes a blade member 92, a support member 93, and a reinforcing member 94.

The blade member 92 is formed of a flexible thin metal plate or the like and has a generally flat plate shape that is substantially rectangular in a plan view and elongated in the left-right direction. A contact part 95 is provided on the blade member 92.

The contact part 95 is formed of an elastic resin, such as urethane rubber. The contact part 95 is disposed to extend in the left-right direction along the rear surface of the blade member 92 near the bottom edge thereof. The contact part 95 has a general arc shape in a side cross-sectional view, with its convex side facing rearward.

A through-hole (not shown) is also formed in each of left and right end portions of the blade member 92. The through-holes are generally circular in a front view.

The support member 93 is formed of a metal plate or the like that is thicker than the blade member 92 and has a general L-shape in a side cross-sectional view. More specifically, the support member 93 is provided with a horizontal portion extending in the front-rear direction, and a vertical portion extending downward from a rear edge of the horizontal portion. The support member 93 is provided with two engaging parts 96 (see FIG. 4) and four second threaded holes 99.

Figure 4:
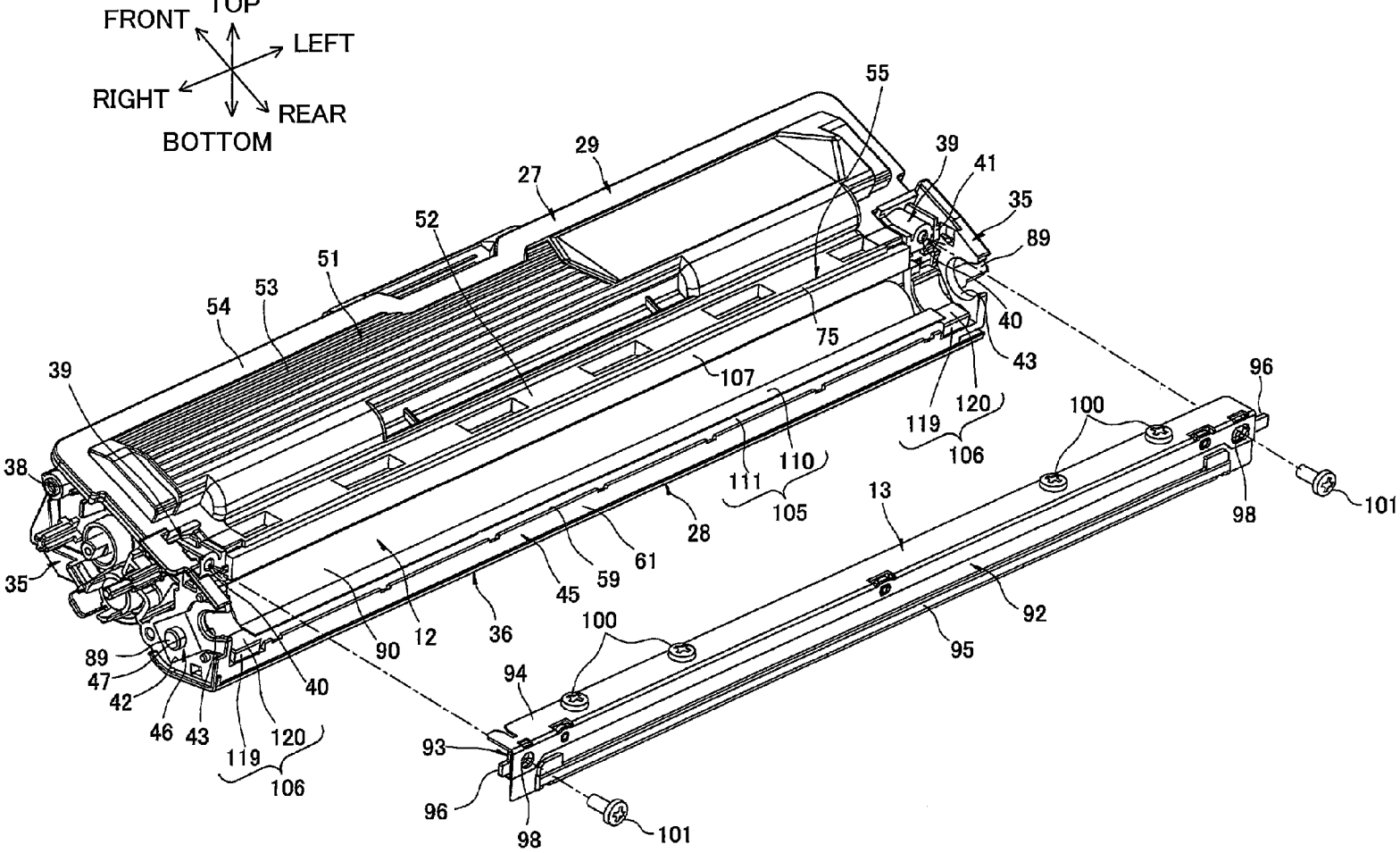
FIG. 4 is an exploded perspective view of the developing cartridge of FIG. 2, illustrating how a thickness-regulating blade is assembled to the developing cartridge.

As shown in FIG. 4, the engaging parts 96 have a general square columnar shape and protrude outward in respective left and right directions from corresponding left and right ends on the vertical portion of the support member 93.

As shown in FIG. 6A, the second threaded holes 99 penetrate the horizontal portion of the support member 93 through its thickness dimension (vertically). The second threaded holes 99 are spaced at intervals in the left-right direction.

A through-hole (not shown) is formed in each of left and right end portions on the vertical portion of the support member 93. The through-holes are generally circular in a front view.

As with the support member 93, the reinforcing member 94 is formed of a metal plate or the like that is thicker than the blade member 92 and has a general L-shape in a side cross-sectional view. The reinforcing member 94 includes a horizontal portion extending in the front-rear direction, and a vertical portion extending downward from a rear edge of the horizontal portion.

Four through-holes (not shown) are formed in the horizontal portion of the reinforcing member 94. The through-holes are spaced at the same intervals as the second threaded holes 99 formed in the support member 93.

A through-hole (not shown) is formed in each of the left and right end portions on the vertical portion of the reinforcing member 94. The through-holes are generally circular in a front view.

The blade member 92 is assembled on a rear surface of the vertical portion of the support member 93, and the reinforcing member 94 is assembled over the support member 93 so as to cover the top thereof. More specifically, the vertical portions of the support member 93 and reinforcing member 94 are assembled so that their horizontal portions confront each other vertically and their vertical portions confront each other in the front-rear direction.

Finally, screws 100 are inserted through the through-holes formed in the horizontal portion of the reinforcing member 94 and screwed into the second threaded holes 99 formed in the support member 93. Thus, the thickness-regulating blade 13 is formed by fixing the support member 93 to the reinforcing member 94 with the blade member 92 interposed therebetween Subsequently, the thickness-regulating blade 13 is fixed to the cartridge frame 27. This is accomplished by inserting screws 101 through the through-holes formed in the vertical portion of the reinforcing member 94, the through-holes formed in the blade member 92, and the through-holes formed in the vertical portion of the support member 93 (hereinafter referred to as through-holes 98) and by screwing the screws 101 into the first threaded holes 40 formed in the blade-fixing part 39.

The lower seal 105 is configured of a sponge 111, and a film 110.

The sponge 111 is formed of elastic foam, such as a urethane sponge member. The sponge 111 has a generally square columnar shape that is substantially rectangular in a side view and elongated in the left-right direction (see FIG. 3). The sponge 111 has a vertical dimension that is greater than the vertical dimensions of the front lower-seal-retaining wall 60 and the rear lower-seal-retaining wall 61.

The film 110 is a sheet-like member formed of polyethylene terephthalate (PET) and covers a top surface of the sponge 111.

The lower side of the rubber roller 88 constituting the developing roller 11 confronts and contacts an upper surface of the lower seal 105 (the top surface of the film 110; hereinafter called a lower-seal first surface 113). As shown in FIG. 6C, the lower-seal-retaining unit 45 holds a lower portion of the lower seal 105. More specifically, the lower seal 105 has a bottom surface (hereinafter called a lower-seal second surface 114) that is in contact with the top surface of the bottom lower-seal-retaining wall 62. At this time, the first restricting protrusions 68 on the bottom lower-seal-retaining wall 62 protrude into the lower seal 105 such that the first distal end portions 69 of the first restricting protrusions 68 are positioned between the lower-seal first surface 113 and lower-seal second surface 114.

In addition, the lower seal 105 has a lower portion whose front surface (hereinafter called a lower-seal third surface 115) is in contact with the orthogonal surface 65 of the front lower-seal-retaining wall 60. The lower portion of the lower seal 105 has a rear surface (hereinafter called a lower-seal fourth surface 116) that is in contact with the sloped surface 71 of the rear lower-seal-retaining wall 61.

The two developing-chamber side seals 106 function to prevent toner from leaking out of the developing chamber 57 at the left and right ends thereof. Therefore, the developing-chamber side seals 106 are provided to correspond to the supply-roller side seals 46.

As shown in FIG. 3, each developing-chamber side seal 106 has a base 119, and a napped member 120.

The base 119 is formed of elastic foam, such as a urethane sponge member, and has a general C-shape in a side view that is open rearward. Each base 119 has a laterally inner portion (right or left inner portion) on which a protrusion is formed. The protrusion has a generally square columnar shape and protrudes upward from a top surface of the corresponding inner portion of the base 119.

The napped member 120 is formed of a polytetrafluoroethylene felt and has a general C-shape in a side view, with its opening on the rear side. The napped member 120 is adhesively fixed to a rear surface of the base 119 such that an upper edge of the napped member 120 is flush with the upper edge of the base 119 (excluding the protrusion formed on the base 119), and a rear edge of the napped member 120 is flush with a rear edge of the base 119.

The developing-chamber side seals 106 are disposed on top surfaces of the corresponding supply-roller side seals 46 for contacting the peripheral surface of the rubber roller 88 on respective left and right ends.

As shown in FIG. 3, the upper seal 107 has a generally square columnar shape that is substantially rectangular in a side view (see FIG. 6A) and elongated in the left-right direction. The upper seal 107 is formed of elastic foam, such as a urethane sponge member. The upper seal 107 has a left-right dimension that is larger than the left-right dimensions of the top upper-seal-retaining wall 75 and bottom upper-seal-retaining wall 76. The upper seal 107 has a rear surface (hereinafter called an upper-seal first surface 124) that is in contact with the thickness-regulating blade 13, and specifically the front surface of the blade member 92 and the front surface of the vertical portion constituting the support member 93. As shown in FIG. 6B, a front portion of the upper seal 107 is held by the upper-seal-retaining unit 55 such that the front surface of the upper seal 107 (hereinafter called an upper-seal second surface 125) is in contact with the rear surface of the front upper-seal-retaining wall 77. At this time, the second restricting protrusions 82 on the front upper-seal-retaining wall 77 protrude into the upper seal 107 so that second distal end portions 83 on the second restricting protrusions 82 are positioned between the upper-seal first surface 124 and upper-seal second surface 125.

In addition, the upper seal 107 has a front portion whose top surface (hereinafter called an upper-seal third surface 126) is in contact with the orthogonal surface 80 of the top upper-seal-retaining wall 75, while the front portion of the upper seal 107 has its bottom surface (hereinafter called an upper-seal fourth surface 127) in contact with the orthogonal surface 84 of the bottom upper-seal-retaining wall 76.

(4) Assembling the Developer Cartridge

To assemble the developing cartridge 7, first the lower seal 105 is set into the lower-seal-retaining unit 45 of the bottom wall 36, as illustrated in FIG. 3. Note that the supply roller 12 and developing-chamber side seals 106 have already been assembled in the cartridge frame 27, as described above (see FIG. 4). To mount the lower seal 105 in the lower-seal-retaining unit 45, the lower seal 105 is positioned above the lower-seal-retaining unit 45, then inserted downward between the front lower-seal-retaining wall 60 and rear lower-seal-retaining wall 61 so that the lower rear edge (the bordering edge between the lower-seal second surface 114 and lower-seal fourth surface 116) slides along the sloped surface 71 of the rear lower-seal-retaining wall 61. Through this operation, outer left and right end faces of the lower seal 105 are in contact with inner left and right surfaces of the developing-chamber side seals 106, as shown in FIG. 4. Further, the lower-seal second surface 114 of the lower seal 105 is in contact with the top surface of the bottom lower-seal-retaining wall 62, as shown in FIG. 6C.

Since the first restricting protrusions 68 provided in the first accumulating recessed parts 67 protrude above the top surface of the bottom lower-seal-retaining wall 62, as illustrated in FIG. 6C, the first restricting protrusions 68 pierce the lower seal 105 from below (from the lower-seal second surface 114 side) such that the first distal end portions 69 of the first restricting protrusions 68 are positioned between the lower-seal first surface 113 and lower-seal second surface 114 of the lower seal 105.

Next, the upper seal 107 is mounted in the upper-seal-retaining unit 55 of the upper frame 29. To mount the upper seal 107 in the upper-seal-retaining unit 55, the upper seal 107 is placed rearward of the upper-seal-retaining unit 55, as illustrated in FIG. 3, then is inserted between the top upper-seal-retaining wall 75 and bottom upper-seal-retaining wall 76. Through this operation, outer left and right end faces of the upper seal 107 on the lower portion thereof are in contact with the inner left and right surfaces on the protrusions of the developing-chamber side seals 106 (see FIG. 4). Further, the upper-seal second surface 125 of the upper seal 107 is in contact with the rear surface of the front upper-seal-retaining wall 77, as shown in FIG. 6B.

Since the second restricting protrusions 82 provided in the second accumulating recessed parts 81 protrude farther rearward than the rear surface of the front upper-seal-retaining wall 77 at this time, the second restricting protrusions 82 pierce the upper-seal second surface 125 side of the upper seal 107 such that the second distal end portions 83 of the second restricting protrusions 82 are positioned between the upper-seal first surface 124 and upper-seal second surface 125 of the upper seal 107.

Figure 5:
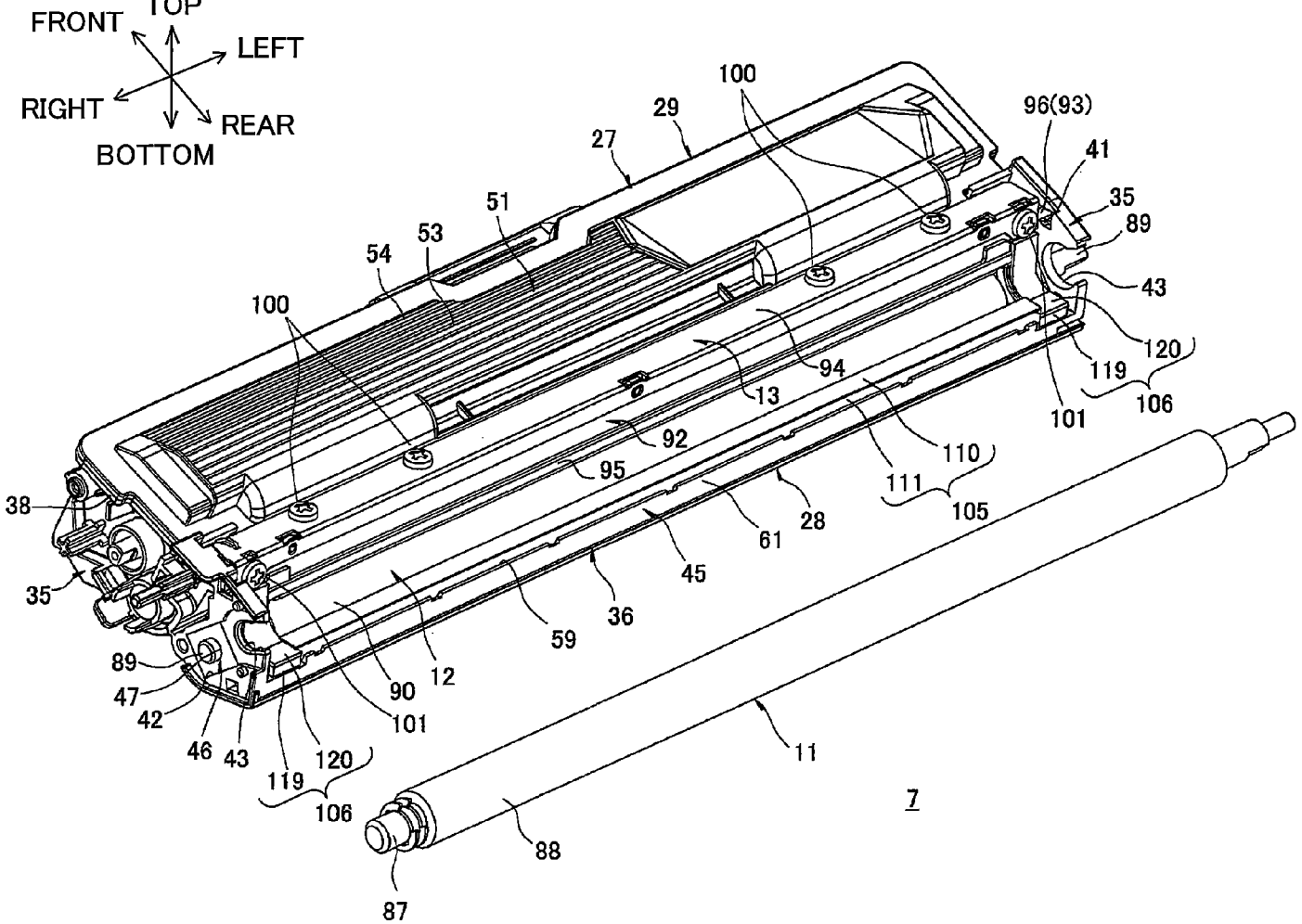
FIG. 5 is an exploded perspective view of the developing cartridge of FIG. 2, illustrating how a developing roller is assembled to the developing cartridge.

Next, the thickness-regulating blade 13 is assembled to the cartridge frame 27. To mount the thickness-regulating blade 13 in the cartridge frame 27, first the thickness-regulating blade 13 is placed on the rear side of the cartridge frame 27, as shown in FIG. 4. Next, the thickness-regulating blade 13 is laid over the cartridge frame 27 such that the engaging parts 96 are engaged in the engaging grooves 41 formed in the side walls 35, as shown in FIG. 5. At this time, the first threaded holes 40 formed in the blade-fixing parts 39 of the side walls 35 are exposed in the through-holes 98 formed in the thickness-regulating blade 13.

Next, the screws 101 are inserted through the through-holes 98 of the thickness-regulating blade 13 and screwed into the corresponding first threaded holes 40. By fastening the thickness-regulating blade 13 to the cartridge frame 27 with the screws 101, the operation for assembling the thickness-regulating blade 13 to the cartridge frame 27 is complete, as illustrated in FIG. 5. At this time, the vertical portion of the support member 93 presses against an upper portion of the upper-seal first surface 124 of the upper seal 107, pushing the upper portion forward, while a lower portion of the upper-seal first surface 124 is in contact with the blade member 92 (the front surface of the blade member 92).

Next, the developing roller 11 is assembled in the cartridge frame 27. To assemble the developing roller 11 in the cartridge frame 27, the left and right ends of the developing-roller shaft 87 are rotatably supported in the developing-roller-exposing grooves 43 of the side walls 35. In this state, the peripheral surface of the developing roller 11 confronts and contacts the top surface of the lower seal 105 and confronts and contacts a rear portion of the contact part 95 provided on the blade member 92. This completes the operation for assembling the developing roller 11 in the cartridge frame 27.

In this state, the lower seal 105 is elastically deformed by downward pressure of the developing roller 11, and the lower-seal fourth surface 116 of the lower seal 105 contacts the sloped surface 71 of the rear lower-seal-retaining wall 61. Further, through the developing roller 11 contacting the rear portion of the contact part 95, the lower end of the blade member 92 is elastically deformed (i.e., bent forward). Consequently, the blade member 92 presses against the upper-seal first surface 124 on the lower portion of the upper seal 107.

This completes assembly of the developing cartridge 7.

3. Operations and Technical Advantages (1) In the developing cartridge 7 of the present embodiment, as shown in FIGS. 6A through 6C, placing the lower seal 105 in contact with the first restricting protrusions 68 and the upper seal 107 in contact with the second restricting protrusions 82 restricts movement of the lower seal 105 and upper seal 107 in the left-right direction (longitudinal direction) without the use of adhesive. Hence, through a simple construction, the lower seal 105 can be mounted in the lower-seal-retaining unit 45 of the cartridge frame 27 and placed in contact with the first restricting protrusions 68, while the upper seal 107 can be mounted in the upper-seal-retaining unit 55 of the cartridge frame 27 and placed in contact with the second restricting protrusions 82. Therefore, the lower seal 105 and upper seal 107 are easily mounted in the cartridge frame 27 and can reliably suppress toner leakage from the cartridge frame 27.

(2) The developing cartridge 7 of the present embodiment has protrusions (the first restricting protrusions 68 and second restricting protrusions 82) extending from the cartridge frame 27. Hence, by contacting and protruding into the lower seal 105 with the first restricting protrusions 68, the first distal end portions 69 of the first restricting protrusions 68 can be positioned between the lower-seal first surface 113 and lower-seal second surface 114 of the lower seal 105. Further, by contacting and piercing the upper seal 107 with the second restricting protrusions 82, the second distal end portions 83 of the second restricting protrusions 82 can be positioned between the upper-seal first surface 124 and upper-seal second surface 125 of the upper seal 107. In this way, the lower seal 105 and upper seal 107 are reliably mounted on the cartridge frame 27, and movement of the lower seal 105 and upper seal 107 in the left-right direction is reliably restrained.

(3) As shown in FIG. 6A, the lower seal 105 is disposed between the cartridge frame 27 and developing roller 11. This configuration suppresses toner leakage between the cartridge frame 27 and the developing roller 11.

(4) Further, as the lower seal 105 follows the rotation of the developing roller 11, the lower-seal third surface 115 of the lower seal 105 is pressed against the front lower-seal-retaining wall 60. Accordingly, the front lower-seal-retaining wall 60 can restrain the lower seal 105 from moving downstream in the rotating direction X of the developing roller 11 as the developing roller 11 rotates.

(5) In the developing cartridge 7 of the present embodiment, the lower seal 105 is disposed between the front lower-seal-retaining wall 60 and rear lower-seal-retaining wall 61, and the upper seal 107 is disposed between the top upper-seal-retaining wall 75 and bottom upper-seal-retaining wall 76. With this configuration, the lower seal 105 and upper seal 107 can be reliably positioned relative to the cartridge frame 27.

(6) Further, as shown in FIG. 6C, by providing the bottom lower-seal-retaining wall 62 for connecting the front lower-seal-retaining wall 60 and the rear lower-seal-retaining wall 61, the lower seal 105 not only can be disposed between the front lower-seal-retaining wall 60 and rear lower-seal-retaining wall 61, but also can be reliably supported by the bottom lower-seal-retaining wall 62. In addition, the first restricting protrusions 68 are provided on the bottom lower-seal-retaining wall 62 at positions downstream of the lower seal 105 with respect to a direction in which the lower seal 105 is mounted between the front lower-seal-retaining wall 60 and rear lower-seal-retaining wall 61. This construction ensures that the first restricting protrusions 68 contact the lower seal 105 when the lower seal 105 is mounted in the cartridge frame 27. In this way, the lower seal 105 can be both reliably supported and restrained from moving in the left-right direction.

Further, as shown in FIG. 6B, since the front upper-seal-retaining wall 77 is provided for connecting the top upper-seal-retaining wall 75 and bottom upper-seal-retaining wall 76, the upper seal 107 can be disposed between the top upper-seal-retaining wall 75 and bottom upper-seal-retaining wall 76 and can be reliably supported by the front upper-seal-retaining wall 77. In addition, the second restricting protrusions 82 are provided on the front upper-seal-retaining wall 77 at positions downstream of the upper seal 107 with respect to a direction in which the upper seal 107 is mounted between the top upper-seal-retaining wall 75 and bottom upper-seal-retaining wall 76. This configuration ensures that the second restricting protrusions 82 can contact the upper seal 107 when the upper seal 107 is mounted in the cartridge frame 27. Accordingly, the upper seal 107 can be both reliably supported and restrained from moving in the left-right direction.

(7) Further, as shown in FIG. 6C, the lower seal 105 can be assembled in the cartridge frame 27 with the lower-seal fourth surface 116 of the lower seal 105 abutting the sloped surface 71 on the rear lower-seal-retaining wall 61. Hence, the lower seal 105 can be positioned with precision relative to the cartridge frame 27 when mounted therein.

(8) As shown in FIGS. 6A and 6C, the direction in which the lower seal 105 moves along with the rotation of the developing roller 11 is an approximate right angle to the orthogonal surface 65 of the lower-seal-retaining unit 45. Therefore, the lower seal 105 following the rotation of the developing roller 11 applies a near-normal force to the orthogonal surface 65 of the front lower-seal-retaining wall 60. This configuration ensures that the lower seal 105 is in close contact with the front lower-seal-retaining wall 60 and can more reliably suppress toner leakage from the cartridge frame 27.

(9) Further, as shown in FIGS. 6A and 6C, as the lower seal 105 follows the rotation of the developing roller 11, the lower seal 105 presses against the first restricting protrusions 68 in the rotating direction X. Since the first restricting protrusions 68 are provided with the sloped surfaces 70 that slope upstream in the rotating direction X, the first restricting protrusions 68 can reliably pierce the lower seal 105. This configuration ensures that the lower seal 105 is securely mounted in the cartridge frame 27.

(10) Further, since the sloped surface 70 forms an acute angle with the top surface of the bottom lower-seal-retaining wall 62, the lower seal 105 is unlikely to separate upward from the cartridge frame 27.

(11) As shown in FIG. 6C, providing the first restricting protrusions 68 in the first accumulating recessed parts 67 allocates more space for providing the first restricting protrusions 68 with greater length in their protruding direction than if the first restricting protrusions 68 were directly disposed on the bottom lower-seal-retaining wall 62. That is, if the first distal end portions 69 of the first restricting protrusions 68 are at the same height in both cases, the first restricting protrusions 68 provided in the first accumulating recessed parts 67 will be longer by an amount equivalent to the depth of the first accumulating recessed parts 67. Since the length of the first restricting protrusions 68 is greater when the first accumulating recessed parts 67 are provided than when the first accumulating recessed parts 67 are not provided, movement-restricting ability of the first restricting protrusions 68 is enhanced. Therefore, since the lower seal 105 is placed in contact with first restricting protrusions 68 having a greater protruding length, movement of the lower seal 105 in the left-right direction can be reliably restrained. The first accumulating recessed parts 67 can also absorb deformation of the lower seal 105 due to contact with the first restricting protrusions 68.

Similarly, as shown in FIG. 6B, providing the second restricting protrusions 82 in the second accumulating recessed parts 81 allocates more space for providing the second restricting protrusions 82 with greater length in their protruding direction than if the second restricting protrusions 82 were directly disposed on the front upper-seal-retaining wall 77. That is, if the second distal end portions 83 of the second restricting protrusions 82 are at the same height in both cases, the second restricting protrusions 82 provided in the second accumulating recessed parts 81 will be longer by an amount equivalent to the depth of the second accumulating recessed parts 81. Since the length of the second restricting protrusions 82 is greater when the second accumulating recessed parts 81 are provided than when the second accumulating recessed parts 81 are not provided, the movement-restricting ability of the second restricting protrusions 82 is enhanced. Therefore, since the upper seal 107 is placed in contact with the second restricting protrusions 82 having a greater protruding length, movement of the upper seal 107 in the left-right direction can be reliably restrained. The second accumulating recessed parts 81 can also absorb deformation of the lower seal 105 due to contact with the second restricting protrusions 82.

As a result, the formation of the first accumulating recessed parts 67 and the second accumulating recessed parts 81 contribute to space conservation within the cartridge frame 27.

(12) Further, when toner gets in-between the cartridge frame 27 and lower seal 105, the toner can accumulate in the first accumulating recessed parts 67. Accordingly, gaps are not formed between the cartridge frame 27 and the lower seal 105 when toner enters therebetween, thereby more reliably suppressing toner leakage from the cartridge frame 27. Similarly, when toner gets between the cartridge frame 27 and upper seal 107, the toner can accumulate in the second accumulating recessed parts 81. Accordingly, gaps are not formed between the cartridge frame 27 and upper seal 107 due to the toner entering between the cartridge frame 27 and upper seal 107, thereby more reliably suppressing toner leakage from the cartridge frame 27.

(13) The first restricting protrusions 68 are provided on the downstream side of the lower seal 105 relative to the rotating direction X of the developing roller 11 (i.e., on the side nearest the front lower-seal-retaining wall 60). In other words, the first restricting protrusions 68 are positioned to be deviated to a downstream side on the bottom lower-seal-retaining wall 62 in the rotating direction X. This construction enables the lower seal 105 to be arranged such that gaps are not formed between the lower seal 105 and front lower-seal-retaining wall 60 when the developing roller 11 rotates. This construction can thus more reliably suppress toner leakage between the lower seal 105 and the front lower-seal-retaining wall 60.

(14) As shown in FIGS. 6A and 6B, the upper seal 107 disposed between the cartridge frame 27 and thickness-regulating blade 13 can suppress toner from leaking between the cartridge frame 27 and thickness-regulating blade 13.

(15) Further, the elastic sponge 111 of the lower seal 105 ensures that the film 110 is more reliably pressed against the developing roller 11. Hence, the lower seal 105 having this configuration can more reliably suppress toner leakage between the lower seal 105 and developing roller 11.

(16) As shown in FIG. 3, the first restricting protrusions 68 are positioned to contact the lower seal 105 at both left and right ends thereof, and the second restricting protrusions 82 are positioned to contact the upper seal 107 at both left and right ends thereof. Accordingly, the first restricting protrusions 68 and second restricting protrusions 82 can respectively restrain movement of the lower seal 105 and upper seal 107 in the left-right direction from the respective left and right ends thereof. This configuration can prevent toner from leaking out of the left and right ends of the lower seal 105 and upper seal 107.

(17) Further, as shown in FIG. 3, pluralities of the first restricting protrusions 68 and second restricting protrusions 82 are provided on both left and right ends of the lower seal 105 and upper seal 107, respectively. Accordingly, the first restricting protrusions 68 and second restricting protrusions 82 can reliably restrain movement of the lower seal 105 and upper seal 107 in the left and right directions at both left and right ends thereof. Thus, this configuration can better suppress toner leakage from the left and right ends of the lower seal 105 and upper seal 107.

(18) Further, forming the first restricting protrusions 68 and second restricting protrusions 82 integrally on the cartridge frame 27 can reduce the number of manufacturing steps and the number of required parts.

4. Second Embodiment

Figure 7B:
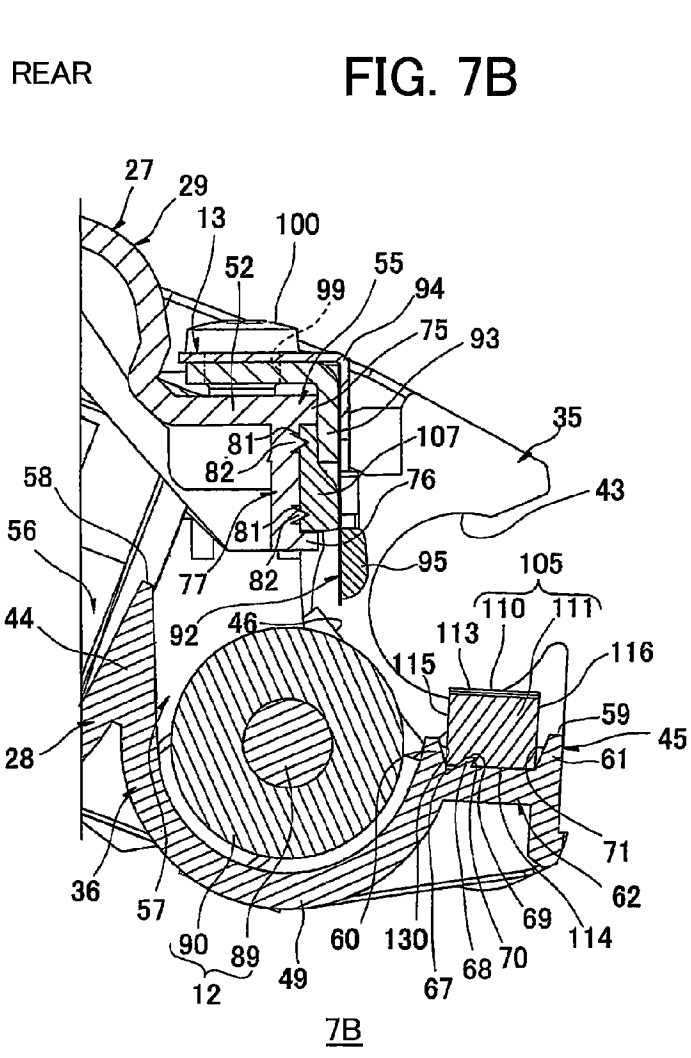
FIG. 7B is an enlarged cross-sectional side view of an essential portion of a developing cartridge according to a third embodiment of the present invention.
Figure 7A:
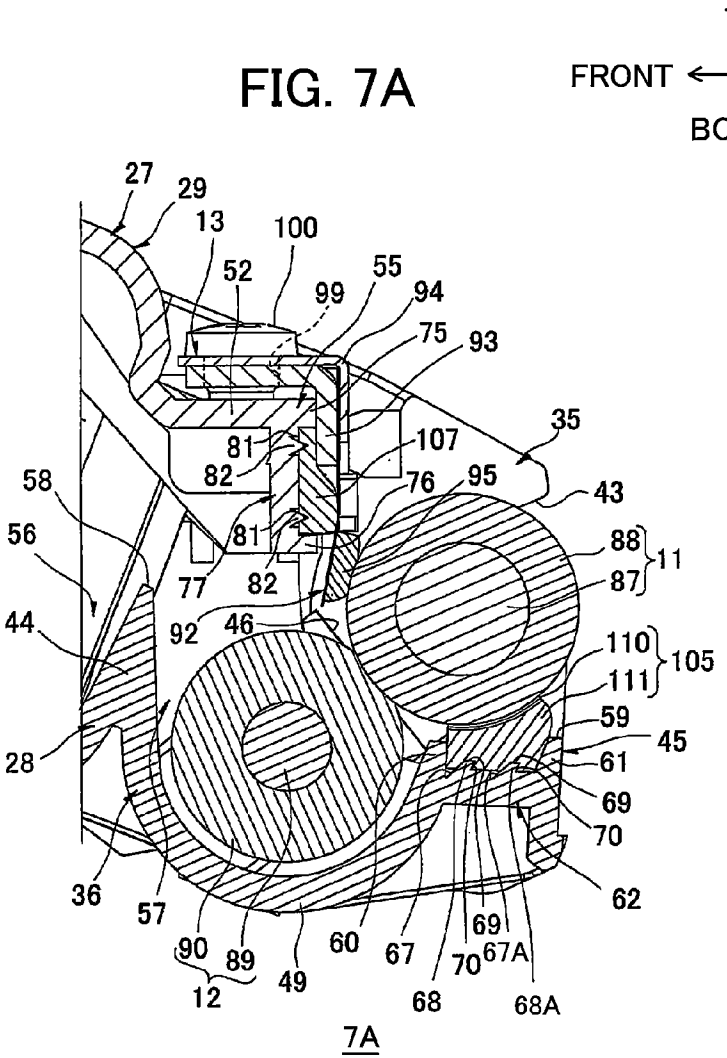
FIG. 7A is an enlarged cross-sectional side view of an essential portion of a developing cartridge according to a second embodiment of the present invention.

A developing cartridge 7A according to a second embodiment of the present invention will be then described with reference to FIG. 7A. In the following description of the second embodiment, like parts and components are designated by the same reference numerals with those of the first embodiment to avoid duplicating description.

In the first embodiment described above, two first accumulating recessed parts 67 are provided in the top surface of the bottom lower-seal-retaining wall 62. The first accumulating recessed parts 67 are formed near the front edge of the bottom lower-seal-retaining wall 62 and are spaced apart in the left-right direction.

In the second embodiment, additional two first accumulating recessed parts 67A are further formed in the top surface of the bottom lower-seal-retaining wall 62 at positions rearward from the two first accumulating recessed parts 67 of the first embodiment. Hence, a total of four first accumulating recessed parts 67 (67, 67A) are formed in the bottom lower-seal-retaining wall 62. The first restricting protrusions 68 are provided in each of the first accumulating recessed parts 67, 67A. The first restricting protrusions 68 are arranged such that the first restricting protrusions 68 in the first accumulating recessed parts 67, 67A spaced apart in the front-rear direction are aligned in the front-rear direction (i.e., the rotating direction X of the developing roller 11).

Providing a plurality of first restricting protrusions 68 along the rotating direction X of the developing roller 11 can reliably restrict the lower seal 105 from moving as the developing roller 11 rotates.

The developing cartridge 7A of the second embodiment can achieve the same operations and technical advantages as those of the first embodiment.

5. Third Embodiment

A developing cartridge 7B according to a third embodiment of the present invention will be then described with reference to FIG. 7B. In the following description of the third embodiment, like parts and components are designated by the same reference numerals with those of the first embodiment to avoid duplicating description.

In the first embodiment described above, the orthogonal surface 65 of the front lower-seal-retaining wall 60 forms an approximate right angle with the top surface of the bottom lower-seal-retaining wall 62. However, in the third embodiment, the front lower-seal-retaining wall 60 has a rear surface that slopes forward toward its topmost sheet from the front edge on the top surface of the bottom lower-seal-retaining wall 62. This rear surface of the front lower-seal-retaining wall 60 is defined as a sloped surface 130 for retaining the lower seal 105.

The lower seal 105 can be mounted in the cartridge frame 27 with the lower-seal third surface 115 of the lower seal 105 conforming to the shape of the sloped surface 130 on the front lower-seal-retaining wall 60. Accordingly, the lower seal 105 can be positioned relative to the cartridge frame 27 with greater precision when mounting the lower seal 105 in the cartridge frame 27.

The developing cartridge 7B of the third embodiment can achieve the same operations and technical advantages as those of the first embodiment.

6. Fourth Embodiment

Figure 8B:
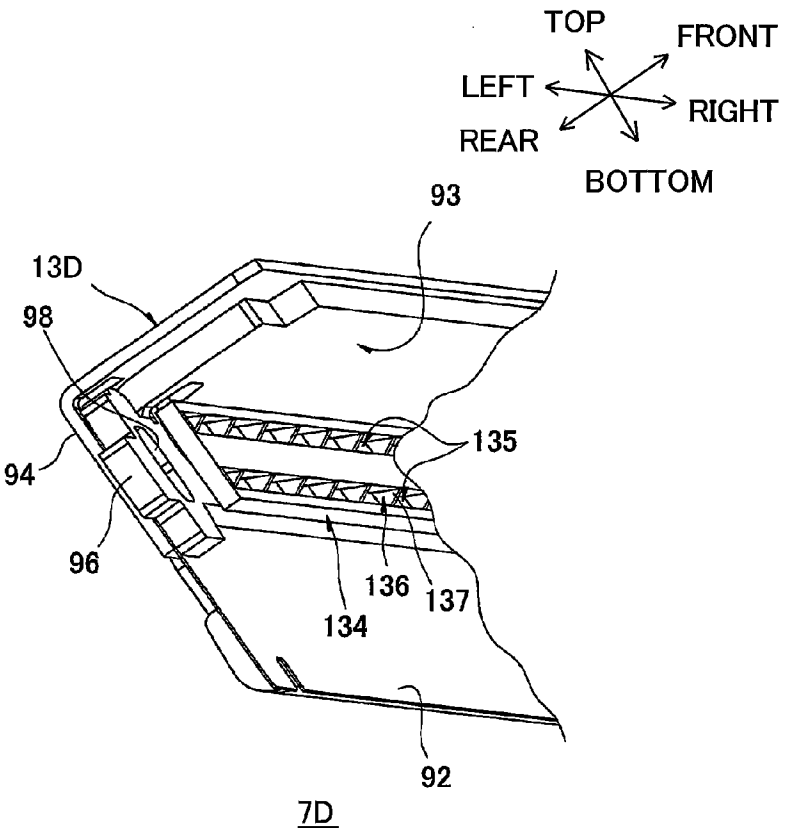
FIG. 8B is a perspective view of an essential portion of a thickness-regulating blade assembled to a developing cartridge according to a fifth embodiment of the present invention, the thickness-regulating blade being viewed from its lower-front side.
Figure 8A:
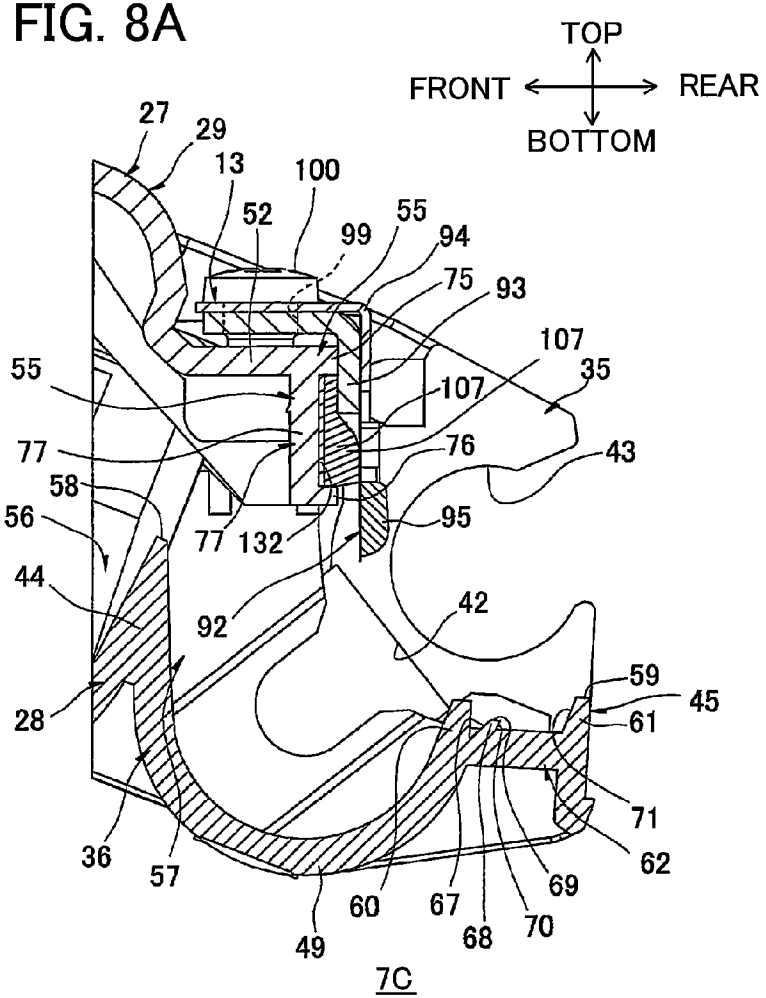
FIG. 8A is an enlarged cross-sectional side view of an essential portion of a developing cartridge according to a fourth embodiment of the present invention.

A developing cartridge 7C according to a fourth embodiment of the present invention will be then described with reference to FIG. 8A. In the following description of the fourth embodiment, like parts and components are designated by the same reference numerals with those of the first embodiment to avoid duplicating description.

In the first embodiment described above, the second accumulating recessed parts 81 are formed in the front upper-seal-retaining wall 77 of the upper-seal-retaining unit 55, and the second restricting protrusions 82 are provided in the second accumulating recessed parts 81. The second restricting protrusions 82 pierce the upper seal 107 to hold the upper seal 107 in the upper-seal-retaining unit 55.

However, in the fourth embodiment, the second accumulating recessed parts 81 and second restricting protrusions 82 are not provided in the front upper-seal-retaining wall 77. Instead, an anti-slip sheet 132 is disposed on the rear surface of the front upper-seal-retaining wall 77. The anti-slip sheet 132 is formed of a silicon rubber, is sheet-like, and covers the entire rear surface of the front upper-seal-retaining wall 77. The anti-slip sheet 132 is affixed to the front upper-seal-retaining wall 77 by adhesive or the like.

When the upper seal 107 is mounted in the upper-seal-retaining unit 55, the anti-slip sheet 132 contacts the upper-seal second surface 125 of the upper seal 107. Friction between the anti-slip sheet 132 and upper-seal second surface 125 restricts movement of the upper seal 107 in the left-right direction.

The developing cartridge 7C of the fourth embodiment can achieve the same operations and technical advantages as those of the first embodiment.

7. Fifth Embodiment

A developing cartridge 7D according to a fifth embodiment of the present invention will be then described with reference to FIG. 8B. In the following description of the fifth embodiment, like parts and components are designated by the same reference numerals with those of the first embodiment to avoid duplicating description.

In the first embodiment described above, the second accumulating recessed parts 81 are formed in the front upper-seal-retaining wall 77 of the upper-seal-retaining unit 55, and the second restricting protrusions 82 are provided in the second accumulating recessed parts 81. The second restricting protrusions 82 protrude into the upper seal 107 to hold the upper seal 107 in the upper-seal-retaining unit 55.

However, in the fifth embodiment, the second accumulating recessed parts 81 and second restricting protrusions 82 are omitted. Instead, a thickness-regulating blade 13D of the fifth embodiment is provided with a back plate 134.

The back plate 134 has a generally flat plate shape and is elongated in the left-right direction. The back plate 134 is fixed to the front surface on the vertical portion of the support member 93. Two third accumulating recessed parts 135 are formed in the back plate 134.

The third accumulating recessed parts 135 are formed in a front surface of the back plate 134 at positions spaced apart vertically. The third accumulating recessed parts 135 are recessed rearward into the front surface of the back plate 134 and are generally rectangular in a plan view, spanning the entire left-right dimension of the back plate 134. A plurality of third restricting protrusions 136 is provided in each third accumulating recessed part 135.

Each third restricting protrusion 136 extends forward from a rear surface of the corresponding third accumulating recessed part 135 so that its distal end (hereinafter called a third distal end portion 137) protrudes farther forward than the front surface of the back plate 134. The third restricting protrusions 136 provided in respective third accumulating recessed parts 135 are positioned so as to be aligned with each other vertically.

While not illustrated in the drawings, the front surface of the back plate 134 contacts the upper-seal first surface 124 of the upper seal 107 when the thickness-regulating blade 13D is mounted in the cartridge frame 27. Since the third restricting protrusions 136 provided in the third accumulating recessed parts 135 protrude farther forward than the front surface of the back plate 134, the third restricting protrusions 136 pierce the upper-seal first surface 124 of the upper seal 107 at this time, with the third distal end portions 137 positioned between the upper-seal first surface 124 and upper-seal second surface 125 of the upper seal 107.

The third restricting protrusions 136 provided on the back plate 134 of the thickness-regulating blade 13D are capable of restricting left-right movement of the upper seal 107 after the upper seal 107 is mounted in the cartridge frame 27, without requiring any restricting parts on the cartridge frame 27 itself. Hence, this construction can reliably suppress toner leakage from the cartridge frame 27.

The developing cartridge 7D of the fourth embodiment provided with the thickness-regulating blade 13D having the back plate 134 can achieve the same operations and technical advantages as those of the first embodiment.

8. Sixth Embodiment

Figure 9:
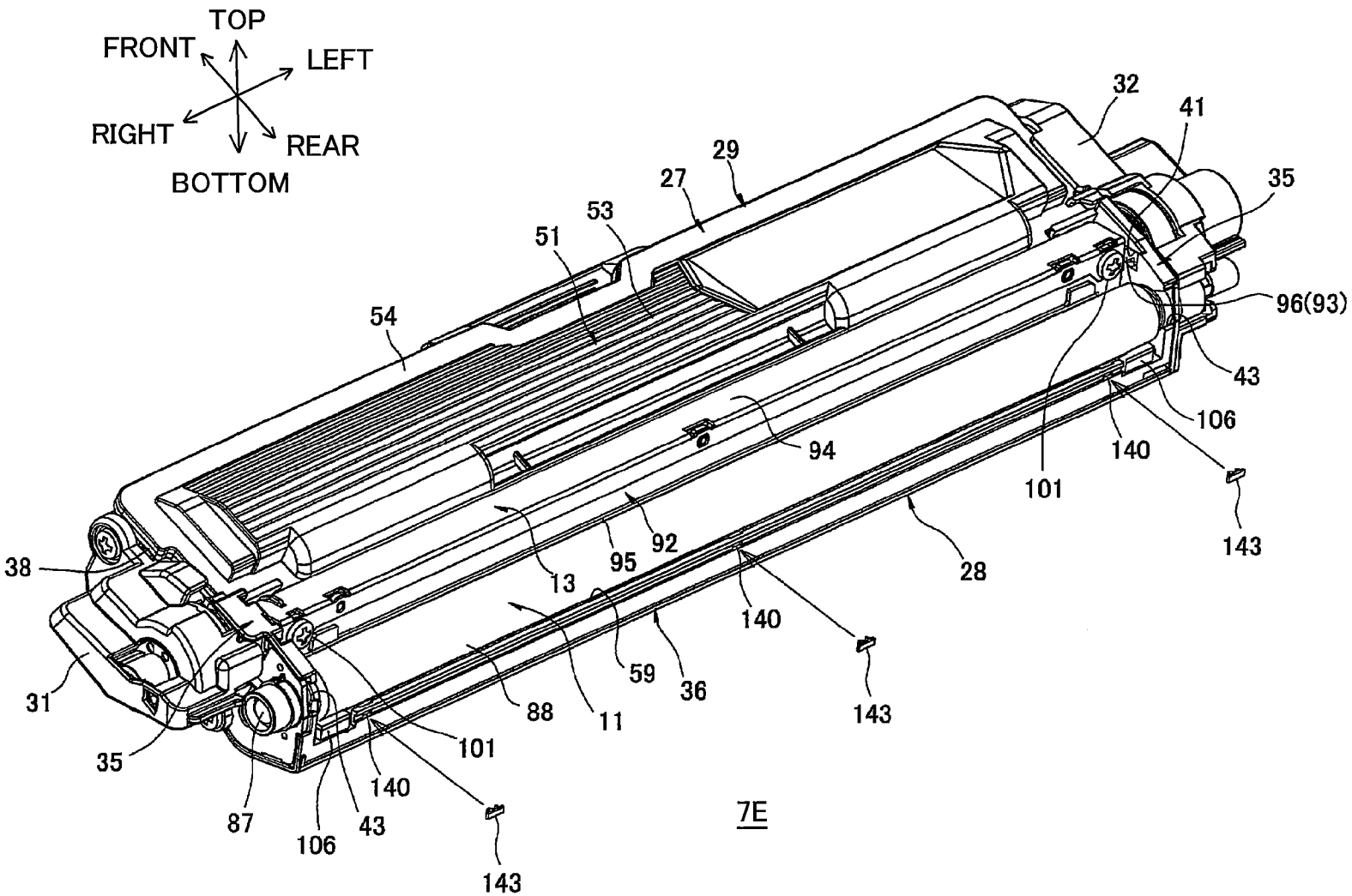
FIG. 9 is a perspective view of a developing cartridge according to a sixth embodiment as viewed from its upper-right side.
Figure 10A:
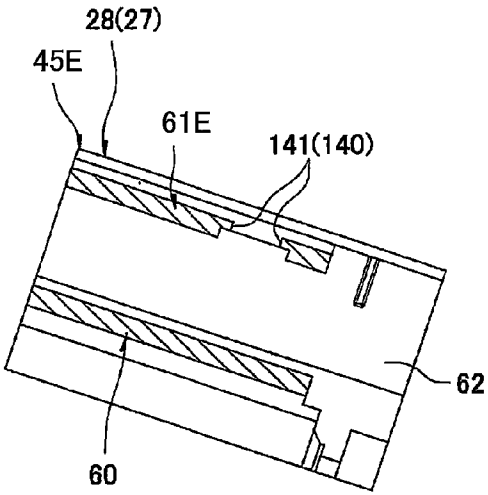
FIG. 10A is an explanatory view illustrating how the developing cartridge of FIG. 9 is assembled, wherein a lower seal is not yet retained in a lower-seal retaining unit.
Figure 10B:
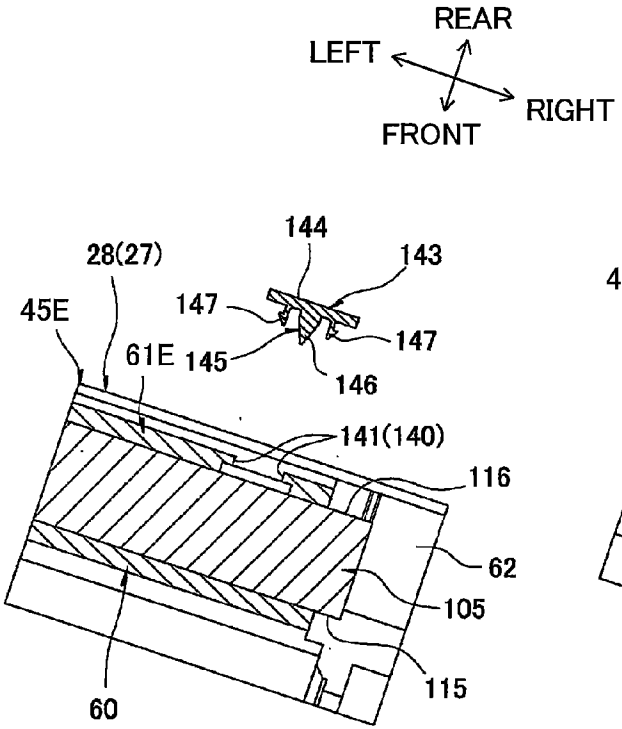
FIG. 10B is an explanatory view illustrating how the developing cartridge of FIG. 9 is assembled, wherein the lower seal is retained in the lower-seal retaining unit but a fitting pin is not yet fitted to the lower-seal retaining unit.
Figure 10C:
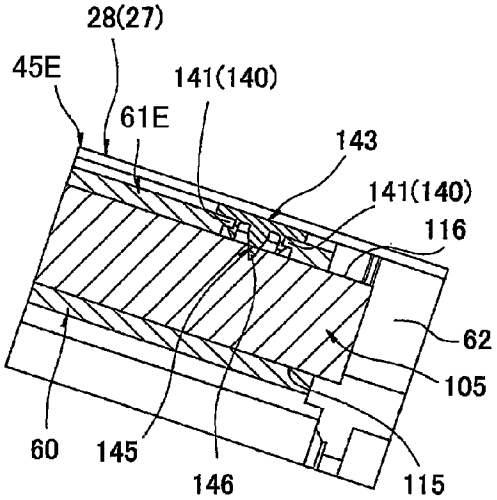
FIG. 10C is an explanatory view illustrating how the developing cartridge of FIG. 9 is assembled, wherein the lower seal is retained in the lower-seal retaining unit and the fitting pin is fitted to the lower-seal retaining unit.

A developing cartridge 7E according to a sixth embodiment of the present invention will be then described with reference to FIGS. 9 to 10C. In the following description of the sixth embodiment, like parts and components are designated by the same reference numerals with those of the first embodiment to avoid duplicating description.

In the first embodiment described above, the lower-seal-retaining unit 45 is provided with the first accumulating recessed parts 67 in which the first restricting protrusions 68 are disposed. However, a lower-seal-retaining unit 45E of the sixth embodiment is not provided with the first accumulating recessed parts 67 or first restricting protrusions 68. Instead, three fitting holes 140 are formed in a rear lower-seal-retaining wall 61E of the lower-seal-retaining unit 45E.

The fitting holes 140 are spaced at intervals in the left-right direction. Each fitting hole 140 is generally rectangular in a rear view and penetrates the rear lower-seal-retaining wall 61E. Each fitting hole 140 includes a pair of engagement parts 141.

The engagement parts 141 are formed in a rear portion of the fitting hole 140, with one disposed on each of left and right edges defining the fitting hole 140. The engagement parts 141 have a generally square columnar shape and protrude laterally inward from the respective right and left edges of the fitting hole 140.

The developing cartridge 7E is also provided with three fitting pins 143. Each fitting pin 143 is configured of a base 144, a fourth restricting protrusion 145, and a pair of engaging pawls 147.

The base 144 has a flat plate shape that is generally rectangular in a rear view.

The fourth restricting protrusion 145 has a generally conical shape and protrudes forward from a front surface of the base 144.

The engaging pawls 147 are provided one on each of the left and right sides of the fourth restricting protrusion 145 and are spaced apart from the fourth restricting protrusion 145. The engaging pawls 147 extend forward from the front surface of the base 144, and have front parts expanding outward in respective left and right directions.

The fitting pins 143 are fitted into the respective fitting holes 140 from the rear side of the rear lower-seal-retaining wall 61E while the lower seal 105 is mounted in the lower-seal-retaining unit 45E. In this operation, the engaging pawls 147 of each fitting pin 143 resiliently deform inward in respective left and right directions when being fitted into the fitting hole 140. Once the expanded parts of the engaging pawls 147 pass over the engagement parts 141 formed in the fitting hole 140, the engaging pawls 147 return to their normal state with the expanded parts contacting and engaging the engagement parts 141 from its front side.

At the same time, the fourth restricting protrusions 145 pierce the lower-seal fourth surface 116 of the lower seal 105, and distal ends (fourth distal end portions 146) of the fourth restricting protrusions 145 become positioned between the lower-seal third surface 115 and lower-seal fourth surface 116 of the lower seal 105. This completes the operation of mounting the fitting pins 143 in the fitting holes 140.

Thus, movement of the lower seal 105 in the left-right direction can be restricted through a simple construction that involves the mounting of fitting pins 143 provided separately from the cartridge frame 27.

The developing cartridge 7E of the sixth embodiment can achieve the same operations and technical advantages as those of the first embodiment.

While the invention has been described in detail with reference to the specific embodiment thereof, it would be apparent to those skilled in the art that various changes and modifications may be made therein without departing from the spirit of the invention.

What is claimed is:

1. A developing cartridge comprising:

a frame defining a developer chamber therein for accommodating developer, the frame having an opening elongated in a longitudinal direction for allowing the developer to flow out of the developer chamber, the frame comprising:

a first wall;

a second wall opposing the first wall in a rotating direction, the second wall being positioned upstream of the first wall in the rotating direction; and a third wall connecting the first wall and the second wall;

a developing roller assembled to the frame at a position opposite to the developer chamber with respect to the opening, the developing roller being configured to rotate in the rotating direction;

a pair of side seals interposed between the developing roller and the frame;

a lower seal extending in the longitudinal direction and interposed between the developing roller and the frame, the lower seal having lateral end portions in the longitudinal direction, each lateral end portion being connected to each of the pair of side seals in the longitudinal direction, the lower seal comprising:

a first surface;

a second surface opposite to the first surface, the second surface being in contact with the third wall of the frame;

a third surface connecting the first surface and the second surface, the third surface being in contact with the first wall of the frame; and a fourth surface connecting the first surface and the second surface and positioned upstream of the third surface in the rotating direction of the developing roller, the fourth surface being in contact with the second wall of the frame; and a protrusion protruding into the lower seal from the third wall of the frame in a protruding direction crossing the longitudinal direction, the protrusion being configured to restrict the lower seal from moving in the longitudinal direction, the protrusion having a distal end positioned between the first surface and the second surface, wherein the protrusion has a sloped surface that slopes obliquely toward the second wall of the frame to form an acute angle with the third wall of the frame.

2. The developing cartridge as claimed in claim 1, wherein the second wall has a sloped surface that slopes upstream in the rotating direction with respect to the protruding direction, the sloped surface contacting the fourth surface when the developing roller is attached to the frame.

3. The developing cartridge as claimed in claim 1, wherein the first wall has an orthogonal surface in-continuous with the third wall and extending in a direction generally orthogonal to the rotating direction.

4. The developing cartridge as claimed in claim 1, wherein the first wall has a sloped surface that slopes downstream in the rotating direction with respect to the protruding direction, the sloped surface of the first wall contacting the third surface when the developing roller is attached to the frame.

5. The developing cartridge as claimed in claim 1, wherein the third wall has a contact surface that contacts the second surface of the lower seal, the contact surface providing a recessed portion between the first wall and the second wall; and wherein the protrusion protrudes from the recessed portion.

6. The developing cartridge as claimed in claim 5, wherein the recessed portion is configured to receive and accumulate developer entering between the lower seal and the frame.

7. The developing cartridge as claimed in claim 1, wherein the protrusion is positioned to be deviated to a downstream side on the third wall in the rotating direction.

8. The developing cartridge as claimed in claim 1, wherein the protrusion comprises a plurality of protrusions aligned in the rotating direction.

9. The developing cartridge as claimed in claim 1, wherein the lower seal comprises:

a film configured to contact the developing roller; and a pressing member configured to press the film against the developing roller.

10. The developing cartridge as claimed in claim 1, wherein the protrusion comprises at least two protrusions configured to contact the lateral end portions.

11. The developing cartridge as claimed in claim 10, wherein the protrusion comprises a pair of at least two protrusions, each pair being configured to contact each lateral end portion of the lower seal.

12. The developing cartridge as claimed in claim 1, wherein the protrusion is integrally formed with the frame.

* * * * *